US005614260A

United States Patent [19]

Darcy

[11] Patent Number: 5,614,260

[45] Date of Patent: Mar. 25, 1997

[54] EXTRUSION SYSTEM WITH SLIDE DIES

[75] Inventor: John J. Darcy, Webster, N.Y.

[73] Assignee: Xerox Corporation, Stamford, Conn.

[21] Appl. No.: 369,458

[22] Filed: Jan. 6, 1995

[51] Int. Cl.[6] ..... B05D 3/12; B05C 3/18

[52] U.S. Cl. ..... 427/277; 427/286; 427/289; 427/356; 118/38; 118/411

[58] Field of Search ..... 427/356, 286, 427/277, 289; 118/410, 411, 38

[56] References Cited

U.S. PATENT DOCUMENTS

| | | | |
|---|---|---|---|
| 2,761,791 | 9/1956 | Russell | 117/34 |
| 3,920,862 | 11/1975 | Damschroder et al. | 427/131 |
| 4,521,457 | 6/1985 | Russell et al. | 427/286 |
| 5,075,139 | 12/1991 | Crumbach et al. | 427/286 |

*Primary Examiner*—Katherine A. Bareford
*Attorney, Agent, or Firm*—Peter H. Kondo

[57] ABSTRACT

A process is disclosed for applying to a surface of a support member at least one ribbon-like stream of a first coating composition side-by-side with at least one ribbon-like stream of a second coating composition comprising providing an extrusion die source for the ribbon-like stream of the first coating composition, providing a slide die source for the ribbon-like stream of the second coating composition, establishing relative motion between the surface of the support member and the source of the ribbon-like streams, simultaneously and continuously applying the ribbon-like streams to the surface of the support member whereby the ribbon-like streams extend in the direction of relative movement of the surface of the support member and the sources of the ribbon-like streams to form a continuous unitary layer having a boundary between the side-by-side ribbon-like streams on the surface of the support member and drying the continuous unitary layer to form a dried coating of the first coating composition side-by-side with a dried coating of the second coating composition. This process may be carried out with apparatus comprising an extrusion die attached to and supporting a slide die, the extrusion die being adapted to applying to a surface of a support member at least one ribbon-like stream of a first coating composition and the slide die being adapted to apply to the surface a ribbon-like stream of a second coating composition side-by-side to and in edge contact with with the ribbon-like stream of the first coating composition.

11 Claims, 4 Drawing Sheets

EXTRUSION SYSTEM WITH SLIDE DIES

BACKGROUND OF THE INVENTION

This invention relates to apparatus for applying to a surface of a support member at least five ribbon-like streams of two different coating composition to form at least five adjacent edge to edge coating layers on the surface of a support member and process for using the apparatus.

Numerous techniques have been devised to form a layer of a coating composition on a substrate. One of these techniques involves the use of an extrusion die from which the coating composition is extruded onto the substrate. For fabrication of web type, flexible electrophotographic imaging members, the extrusion die must lay down very thin coatings meeting extremely precise, critical tolerances in the single or double digit micrometer ranges. Moreover, a plurality of dies may be needed to lay down up to three sequentially extruded coatings conventionally employed for flexible electrophotographic imaging members. The flexible electrophotographic imaging members may also comprise additional coatings applied by non-extrusion coating techniques so that the finished electrophotographic imaging member can contain as many as 4 sequentially applied different coating layers, one of the coating layers can comprising two different coating compositions applied edge to edge.

The extrusion die usually comprises spaced walls, each having a surface facing each other. These spaced walls form a narrow, elongated, passageway. Generally a coating composition is supplied by a reservoir to one side of the passageway and the coating composition travels through the passageway to an exit slot on the side of the passageway opposite the reservoir. The surface of the dams facing the coating composition is generally perpendicular to the exit slot. Dams or side walls are provided at opposite ends of the passageway to confine the coating composition within the passageway as the coating travels from the reservoir to the exit slot. Each end dam or side wall seals one end of the die. A second mini extrusion die may be bolted or otherwise attached to one end of the first extrusion die to share one of the dams of the first extrusion die so that one side of the dam forms one wall of the passageway in the first extrusion die and the other side of the dam forms a wall of the passageway in the second mini extrusion die. This permits the extrusion of an electrically conductive ground strip from the second die edge to edge with the wider charge transport layer coating material extruded from the first main die. Since flexible electrophotographic imaging members usually comprise an electrically conductive ground strip on one edge, this arrangement of extrusion dies is ideal for a fabrication lane which forms a photoreceptor in web form with a narrow electrically conductive ground strip layer along one edge of a charge transport layer. This technique is described in U.S. Pat. No 4,521,457, the entire disclosure thereof being incorporated herein by reference. The photoreceptor web is subsequently sliced transversely to form a rectangular sheet. The rectangular sheet is formed into a belt type photoreceptor by welding opposite ends of the sheet together.

The formation of a photoreceptor in web form using a single extrusion lane is extremely inefficient. A more efficient technique involves bolting a third mini extrusion die on the end of the first extrusion die opposite the end supporting the second mini extrusion die and to lengthen the first die. This establishes dual extrusion lanes for simultaneously fabricating two side by side photoreceptors. Using this technique, and electrically conductive ground strip can be formed along each edge of the enlarged large middle charge transport coating layer formed by the first extrusion die. After all the coatings have been deposited and dried, the web formed using the dual extrusion lanes can be slit longitudinally along its centerline to form two separate photoreceptor webs, each web having an electrically conducting ground strip along one edge thereof and being mirror images of each other. Since there are no additional extrusion die ends available for mounting mini extrusion dies, the maximum number of photoreceptor extrusion lanes available is two. Throughput cannot be increased beyond two photoreceptor extrusion lanes with this type of extrusion die arrangement.

INFORMATION DISCLOSURE STATEMENT

U.S. Pat. No. 4,521,457 to Russell et al., issued Jun. 4, 1985—A process is disclosed in which at least one ribbon-like stream of a first coating composition adjacent to and in edge contact with at least one second ribbon-like stream of a second coating composition are deposited on the surface of a support member by establishing relative motion between the surface of the support member and the ribbon-like streams, simultaneously constraining and forming the ribbon-like streams parallel to and closely spaced from each other, contacting adjacent edges of the ribbon-like streams prior to applying the ribbon-like streams to the surface of the support member and thereafter applying the ribbon-like streams to the surface of the support member.

SUMMARY OF THE INVENTION

It is an object of the invention to provide a process for applying to a surface of a support member at least one ribbon-like stream of a first coating composition side-by-side to and in edge contact with at least one ribbon-like stream of a second coating composition comprising providing an extrusion die source for the ribbon-like stream of the first coating composition, providing a slide die source for the ribbon-like stream of the second coating composition, establishing relative motion between the surface of the support member and the source of the ribbon-like streams, simultaneously and continuously applying the ribbon-like streams to the surface of the support member whereby the ribbon-like streams extend in the direction of relative movement of the surface of the support member and the sources of the ribbon-like streams to form a continuous unitary layer having a boundary between the side-by-side ribbon-like streams on the surface of the support member and drying the continuous unitary layer to form a dried coating of the first coating composition side-by-side with a dried coating of the second coating composition. This process may be carried out with apparatus comprising an extrusion die attached to and supporting a slide die, the extrusion die being adapted to applying to a surface of a support member at least one ribbon-like stream of a first coating composition and the slide die being adapted to apply to the surface a ribbon-like stream of a second coating composition side-by-side to and in edge contact with with the ribbon-like stream of the first coating composition.

BRIEF DESCRIPTION OF THE DRAWINGS

A more complete understanding of the process and apparatus of the present invention can be obtained by reference to the accompanying drawings wherein.

The figures are merely schematic illustrations of the present invention. They are not intended to indicate relative size and dimensions of actual dies.

DESCRIPTION OF THE PREFERRED EMBODIMENTS

Figure 1:
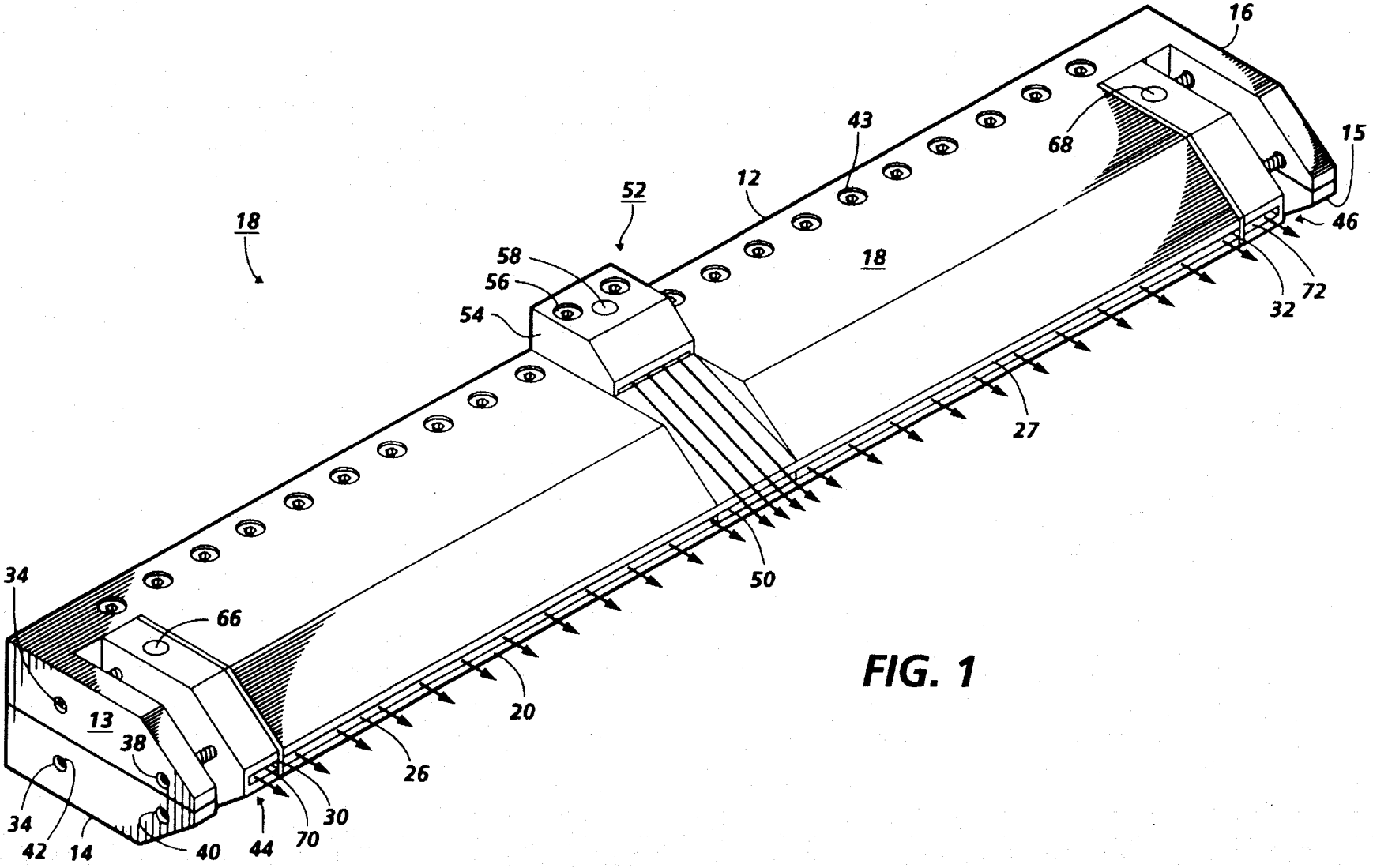
FIG. 1 is a schematic, isometric view of apparatus in which ribbon-like three streams of two different coating compositions are formed parallel to and spaced from each other from a die assembly comprising a main extrusion die, two mini end extrusion dies and a central slide die.
Figure 2:
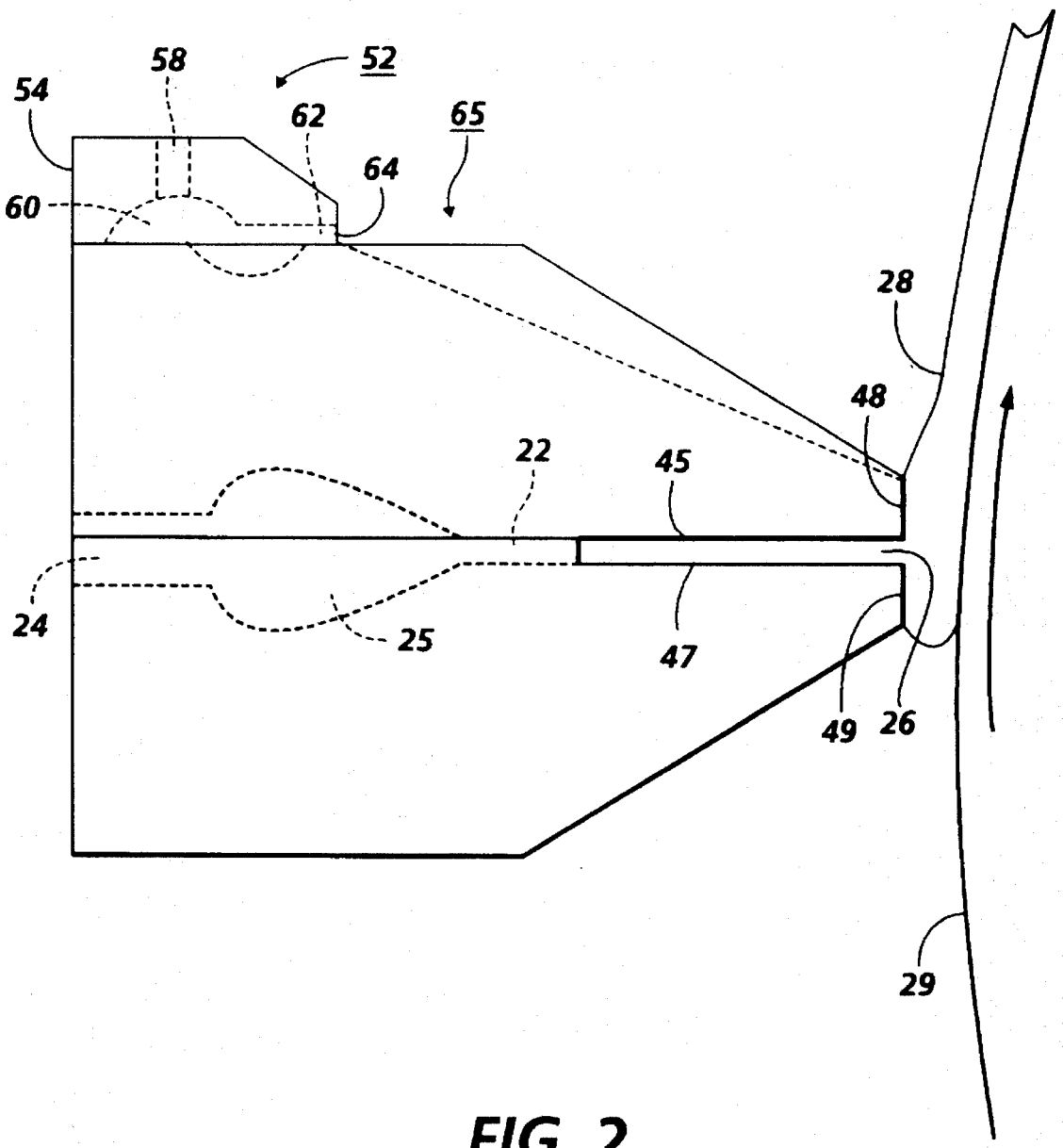
FIG. 2 is a schematic, cross sectional view of the apparatus of FIG. 1 showing the main extrusion die and a central slide die.
Figure 4:
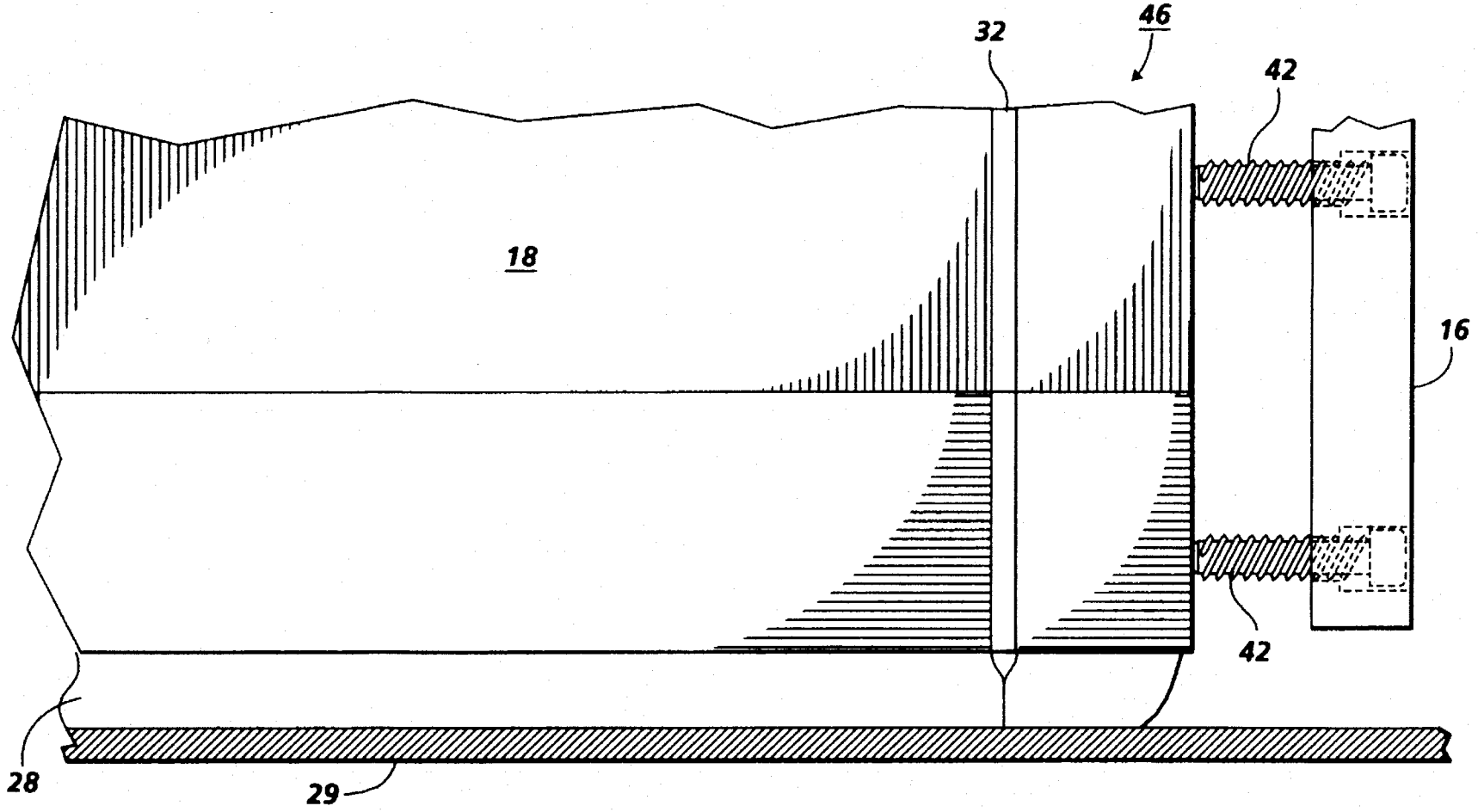
FIG. 4 is a partial schematic view of a mini extrusion die fastened to one end of a large main extrusion die.

Referring to FIGS. 1 and 2, a die assembly designated by the numeral 10 is illustrated. Extrusion dies are utilized for extrusion of coating compositions onto a support. Extrusion dies are well know and described, for example, in U.S. Pat. No. 4,521,457, the entire disclosure thereof being incorporated herein by reference. Die assembly 10 comprises a die body 12 equipped with clamping flanges 13, 14, 15 and 16. Die body 12 comprises and upper lip 18 and lower lip 20 which are spaced apart to form a flat narrow passageway 22 (see FIG. 2) which leads from inlet 24 to manifold 25 to exit slots 26 and 27 through which a first coating composition 28 is extruded as ribbon-like streams in the direction shown by the arrows (see FIG. 1) onto substrate 29 (see FIG. 2) moving in the direction shown by the arrow. The width, thickness, and the like of the ribbon-like stream can be varied in accordance with factors such as the viscosity of the coating composition, thickness of the coating desired, and width of the substrate 29 on which the coating composition is applied, and the like. End dams 30 and 32 (see FIG. 1) are secured to the ends of upper lip 18 and lower lip 20 of die body 12 to confine coating composition 28 within passageway 22 as first coating composition 28 travels from inlet 24 to manifold 25 to exit slots 26 and 27. The length of passageway 22 should be sufficiently long to ensure laminar flow. Control of the distance of exit slots 26 and 27 from substrate 29 enables first coating composition 28 to bridge the gap between each exit slots 26 and 27 and substrate 29 depending upon the viscosity and rate of flow of first coating composition 28 and the relative rate movement between die assembly 10 and substrate 29. Generally, it is preferred to position the narrow extrusion slot outlets for lower viscosity ribbon-like streams closer to the support surface than wider extrusion slot outlets for higher viscosity ribbon-like streams to allow formation of a bead of coating material which functions as a reservoir for greater control of coating deposition. As conventional in the art, first coating composition 28 is supplied from a reservoir (not shown) under pressure using a conventional pump or other suitable well known means such as a gas pressure system (not shown). Clamping flanges 14 and 16 contain threaded holes 34, 36, 38 and 40 into which set screws 42 are screwed to secure end dams 30 and 32 between mini extrusion dies 44 and 46, respectively, and the adjacent ends of upper lip 18 and lower lip 20 of die body 12 (see FIGS. 1 and 4). Any suitable means such as screws 43 or the like, such as bolts, studs, or clamps (not shown), may be utilized to fasten upper lip 18 and lower lip 20 together. Inner lip surfaces 45 and 47 (see FIG. 2) of upper lip 18 and lower lip 20, respectively, are precision ground to ensure accurate control of the deposited coating thickness and uniformity. A plug 50 is positioned between upper lip 18 and lower lip 20 to split the otherwise long exit slot of the die body 12 into separate exit slots 26 and 27. Under stable conditions, the extruded coating materials pins or clings to the outer lip surfaces 48 and 49 of upper lip 18 and lower lip 20, respectively (see FIGS. 2 and 4). Outer lip surfaces 48 and 49 may be of any suitable configuration including squared, knife and the like. A flat squared end is preferred for the coating embodiment illustrated. The flat outer lip surfaces 48 and 49 appear to further support and stabilize the beads during bead coating operations.

Figure 3:
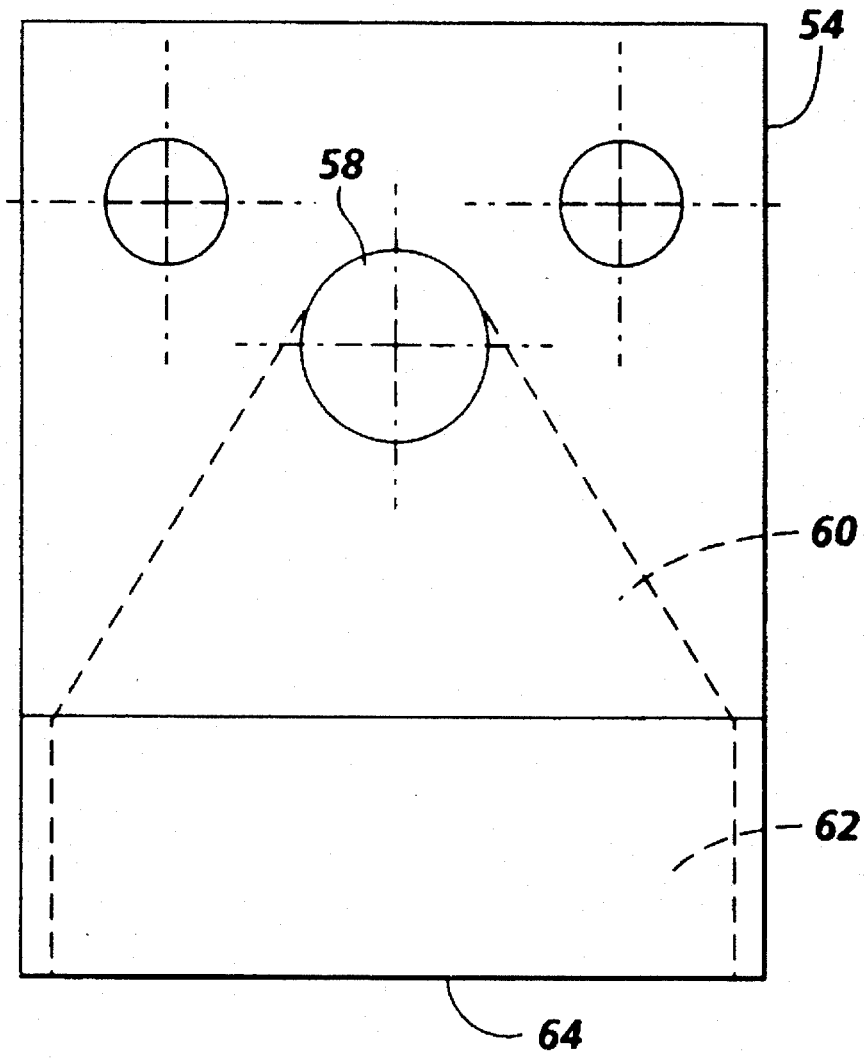
FIG. 3 is a schematic, plan view of the central slide die shown in FIGS. 1 and 2.

A slide die 52 is positioned at the center of die assembly 10. Slide die 52 comprises an upper lip 54 clamped to the top of upper lip 18 of die body 12 with the aid of bolts 56. An inlet 58 leads to a manifold 60 (see FIG. 2) which in turn leads to flat narrow passageway 62. Manifold 60 widens horizontally from inlet 58 to outlet slot 64 (see FIG. 3). A recessed slide ramp 65 leads from the outlet slot 64 of passageway 62 to the outer lip surface 48 of upper lip 18. Mini extrusion dies 44 and 46 contain inlets 66 and 68, respectively, which lead to manifolds (not shown) which in turn lead to outlet slots 70 and 72, respectively. A second coating composition is extruded as three ribbon-like streams in the direction shown by the arrows (see FIG. 1) onto substrate 29 (see FIG. 2) from slide die 52 and mini extrusion dies 44 and 46. The second coating composition is supplied from one or more reservoirs (not shown) under pressure using conventional pumps or other suitable well known pumping means such as a gas pressure system (not shown). The width of outlet slot 64 of slide die 52 is twice as wide as the outlet slots 70 and 72 of mini extrusion dies 44 and 46. Similarly, the width of slide ramp 65 is twice as wide as the outlet slots 70 and 72 of mini extrusion dies 44 and 46. For greater control, a different pump is preferred to feed the second coating composition to slide die 52 than pump employed to feed the second coating composition to mini extrusion dies 44 and 46. The angle of slope for slide ramp 65 is dependent on the viscosity of the second coating composition. Thus, steeper angles of slope should be employed for higher viscosity second coating compositions. Although the width of the slide ramp 65 is shown in FIG. 1 as twice as wide as the slots of mini extrusion dies 44 and 46, it may, if desired, be the same width as the slots of mini extrusion dies 44 and 46. This slide die helps eliminate the blending, scalloping, and edge bead problems encountered where the coating compositions.

Preferably, the main die is utilized to deposit a wide coating electrophotographically active layer on a substrate and the slide die is employed to apply at least one narrow electrically conductive ground strip layer to the substrate adjacent to and in contact with at least one edge of the wide electrophotographically active layer. More preferably, the slide die is utilized to apply at least one single width or double width electrically conductive ground strip layer between at least two wide electrophotographically active layer in at least a double extrusion lane. The expression "single width" or "single wide" as employed herein is defined as the width of a coating in a single photoreceptor that is to ultimately be fabricated, e.g. the width of a single ground strip layer or the width of a single charge transport layer. The expression "double width" or "double wide" as employed herein is defined as the width of two adjacent coatings of two photoreceptors that are to ultimately be fabricated, e.g. the width of a single ground strip layer or the width of a two charge transport layers It should be noted that for multiple photoreceptor widths, the photoreceptors that are to ultimately be fabricated may not necessarily have identical widths. The expression "extrusion lane" as employed herein is defined as a lane of moving coated substrate material formed with a coating die assembly which is only one photoreceptor wide, i.e. it is the sum of the widths of a single wide ground strip layer and the width of a single wide electrophotographically active layer.

Many variations of multiple extrusion lanes may be achieved with the combination of at least extrusion die and at least one slide die. Preferably, the extrusion die applies a first composition comprising electrophotographically active layer coating material and the slide die applies a second composition comprising ground strip layer coating material. All of the variations of multiple extrusion lanes should allow longitudinal slitting of the extrusion coated substrate so that complete combinations of a single wide ground strip layer and a single wide electrophotographically active layer remain on each slit strip. Thus, a double lane extrusion coated web may contain a double wide electrophotographically active layer with a single wide ground strip layer adjacent to and in contact with each of the edges of the double wide electrophotographically active layer. After drying the coated web form a continuous unitary layer having a boundary between the electrophotographically active layer and ground strip layers, the web may be slit along the centerline to split the double wide electrophotographically active layer to form two strips, each strip containing a single wide ground strip layer and a single wide electrophotographically active layer. The expression "boundary" as employed herein is intended to include adjacent layers that touch, overlap or are slightly spaced from each other. Splitting is effected by any suitable technique such as knives, scissors, lasers, rotary knife, and the like. Slitting is accomplished in a direction parallel to the single wide coating. Alternatively, a double lane extrusion coated web may contain two single wide electrophotographically active layers separated by a double wide ground strip layer adjacent to and in contact with an edge of each of the two single wide electrophotographically active layers. After drying the coated web may be slit along the centerline to split the double wide ground strip layer and form two strips. Each strip containing a single wide ground strip layer and a single wide electrophotographically active layer. In still another embodiment, a double lane extrusion coated web may contain two single wide electrophotographically active layers separated by a centrally located single wide electrophotographically active layer adjacent to and in contact with an edge of each of the two single wide electrophotographically active layers and one of these two single wide electrophotographically active layers may have an opposite side in contact with another single side ground strip layer. After drying the coated web may be slit along one edge of the centrally located ground strip layer to form two strips. Each strip containing a single wide ground strip layer and a single wide electrophotographically active layer. However, the most preferred embodiment of this invention enables at least three extrusion lanes which have not been achievable with the prior art combination of one main extrusion die with mini extrusion dies attached at each end. It is the use of slide die of this invention in combination with a main extrusion die that enables at least three extrusion lanes. The variations achievable with at least three extrusion lanes is enormous because of the different ways that an extrusion web may be slit. e.g. slitting a double wide electrophotographically active layer in half, slitting a double wide ground strip layer in half, slitting along one edge of a single wide ground strip layer, various combinations of the aforesaid slitting techniques, and the like.

This die assembly of this invention may be employed to coat the surface of support members of various configurations including webs, sheets, plates, and the like. The support member may be flexible, rigid, uncoated, precoated, as desired. The support members may comprise a single layer or be made up of multiple layers. Also, the coating compositions applied to the support member may comprise molten thermoplastic materials, solutions of film forming materials, curable resins and rubbers, and the like.

Any suitable rigid material may be utilized for the main die body, mini dies and slide die. Typical rigid materials include, for example, stainless steel, chrome plated steel, ceramics, or any other metal or plastic capable of maintaining precise machining tolerances. Stainless steel and plated steel having a nickel plated intermediate coating and a chrome plated outer coating are preferred because of their long wear characteristics and capability of maintaining precise machining tolerances. The main die body and slide die may comprise separate top and bottom sections. If desired, the mini dies may be formed from a single section or a plurality of sections. To achieve the extremely precise coating thickness profiles and exceptional surface quality requirements desired for electrophotgraphic imaging member coatings, the finish grinding of the dies should be accomplished consistently under high tolerance constraints across the entire die width, e.g. widths as high as 122 cm (48 inches). A preferred way to achieve such precision is to continue to move a die grinding wheel beyond the die body at the end of each grinding pass, i.e. the grinding wheel should not stop or slow down at any point while in contact with the die body. Thus, for dies that can meet exacting coating requirements, the use of separate end dams are highly desirable to seal both ends of the die body. Moreover, because the grinding wheel does stop or slow down at any point while in contact with the main die body, all of the die slot surfaces, including the die slot surfaces immediately adjacent the plug (which separates the die slot into at least two separate slots), meet the very high tolerance requirements of precision coating systems. Any suitable machinable material may be used for the end dams. Annealable brass stock material is preferred.

Any suitable and conventional technique may be utilized to machine the dies of this invention. Typical machining techniques include, for example, milling, grinding, die cutting, and the like. Preferably, the dies are machined to achieve the desired shape by using a programmable mill. The machined dies should be rigid Typically, the exit slot of the main die body is normally positioned only about 150 micrometers to 230 micrometers from the electrophotographic imaging member substrate during coating.

The mini and slide dies of this invention may be fastened to at the main die body by any suitable fastening means. Examples of fastening means include, machine screws inserted through holes in mini and/or slide dies and screwed into threaded holes in the main die body; threaded studs mounted in threaded holes in the main die body and extending through holes in the mini and/or slide dies to receive nuts; set screws screwed into threaded holes in frame members or die body clamping flanges to press and clamp the mini and/or slide dies against the main die body; and the like.

Any suitable coating composition may applied to a substrate with the extrusion die of this invention. Generally, the coating composition comprises a film forming polymer and a liquid carrier for the film forming polymer. The liquid carrier may be a solvent which dissolves the film forming polymer or a non-solvent in which the film forming polymer is dispersed or emulsified. Any suitable film forming polymer may be used. Typical film forming polymers include, for example, polycarbonates, polyesters, and the like. Typical solvents or liquid carriers include, for example, methylene chloride, tetrahydrofuran, toluene, methyl ethyl ketone, isopropanol, methanol, cyclohexanone, heptane, other chlorinated solvents, water, and the like. Water is an example of a common non-solvent liquid carrier. The compositions of layers normally extruded onto substrates during the fabrication of electrophotographic imaging members are well known in the art and described in the patent literature. These layers include, for example, adhesive layers, charge generating layers, charge transport layers, anticurl backing layers, and the like.

The selection of the narrow die passageway, exit slot height, slope of the slide ramp and the like generally depends upon factors such as the fluid viscosity, flow rate, distance to the surface of the support member, relative movement between the die and the substrate, the thickness of the coating desired, and the like. Generally, satisfactory results may be achieved with narrow passageway and exit slot heights between about 25 micrometers and about 750 micrometers in the main die and in the mini dies. It is believed, however, that heights greater than 750 micrometers will also provide satisfactory results. Good coating results have been achieved with slot heights between about 100 micrometers and about 250 micrometers. Optimum control of coating uniformity and edge to edge contact are achieved with slot heights between about 150 micrometers and about 200 micrometers. The roof, sides and floor of the narrow die passageway should preferably be parallel and smooth to ensure achievement of laminar flow. The length of the narrow extrusion slot from the manifold to the outlet opening should be sufficient to ensure achievement of laminar flow.

The gap distance between the die outer lip surface adjacent the exit slot and the surface of the substrate to be coated depends upon variables such as viscosity of the coating material, the velocity of the coating material and the angle of the narrow extrusion passageway relative to the surface of the support member. Generally speaking, a smaller gap is desirable for lower flow rates. Regardless of the technique employed, the flow rate and distance should be regulated to avoid splashing, dripping, puddling of the coating material. The slide die slope is a function of the coating solution viscosity.

Relative speeds between the coating die assembly and the surface of the substrate up to about 200 feet per minute have been tested. However, it is believed that greater relative speeds may be utilized if desired. The relative speed should be controlled in accordance with the flow velocity of the ribbon-like stream of coating material.

The flow velocities or flow rate per unit width of the narrow die passageway for the ribbon-like stream of coating materials for the main die, mini dies and slide die should be sufficient to fill the die to prevent dribbling and to bridge the gap as a continuous stream moves to the surface of the substrate from the die assembly. However, the flow velocity should not exceed the point where non-uniform coating thicknesses are obtained due to splashing or puddling of the coating composition. Varying the die to substrate surface distance and the relative die to support member surface speed will help compensate for high or low coating composition flow velocities.

The coating technique of this invention can accommodate an unexpectedly wide range of coating compositions viscosities from viscosities comparable to that-of water to viscosities of molten waxes and molten thermoplastic resins. Generally, lower coating composition viscosities tend to form thinner wet coatings whereas coating compositions having high viscosities tend to form thicker wet coatings. Obviously, wet coating thickness will form thin dry coatings when the coating compositions employed are in the form of solutions, dispersions or emulsions.

The pressures utilized to extrude the coating compositions through the narrow die passageway depends upon the size of the passageway and viscosity of the coating composition.

Any suitable temperature may be employed in the coating deposition process. Generally, ambient temperatures are preferred for deposition of solution coatings. However, higher temperatures may be necessary for depositing coatings such as hot melt coatings.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for preparing an electrostatographic imaging member comprising applying to a surface of a support member at least one ribbon stream of a first coating composition side-by-side with at least one ribbon stream of a second coating composition comprising providing an extrusion die source for said ribbon stream of said first coating composition, providing a slide die source for said ribbon stream of said second coating composition, establishing relative movement between said surface of said support member and said source of said ribbon streams, simultaneously and continuously applying said ribbon streams to said surface of said support member to form a continuous unitary layer having a boundary between said side-by-side ribbon streams on said surface of said support member and drying said continuous unitary layer to form a dried coating of said first coating composition side-by-side with a dried coating of said second coating composition.

2. A process according to claim 1 wherein said ribbon stream of the first coating composition is double wide and said ribbon stream of the second coating composition is single wide, and another single wide ribbon stream of the second coating composition is applied along a second side of said ribbon stream of the first coating composition.

3. A process according to claim 2 including longitudinally slitting said dried coating of said first coating composition.

4. A process according to claim 1 wherein said ribbon stream of the first coating composition is single wide and said ribbon stream of the second coating composition is double wide, and another single wide ribbon stream of a first coating composition is applied along a second side of said ribbon stream of a second coating composition.

5. A process according to claim 4 including longitudinally slitting said imaging member along an imaginary centerline of said dried coating of said second coating composition after said dried coatings of said first coating composition and said dried coating of said second coating composition are formed.

6. A process according to claim 1 wherein said ribbon stream of a first coating composition is double wide and said ribbon stream of a second coating composition is double wide, a second double wide ribbon stream of said first coating composition is applied along a second side of said double wide ribbon stream of said second coating composition, said second double wide ribbon having parallel sides, and additional single wide ribbon streams of said second coating composition are applied to sides of said double wide ribbons of said first composition opposite the side of said first composition adjacent said double wide ribbon stream of said second coating composition.

7. A process according to claim 6 including longitudinally slitting said imaging member along an imaginary centerline of both of the dried coatings of said first coating composition after said dried coatings of said first coating composition and said dried coatings of said second coating composition are formed.

8. Apparatus comprising an extrusion die attached to and supporting a slide die, said extrusion die being adapted to applying to a surface of a support member at least one ribbon stream of a first coating composition and said slide die being adapted to apply to said surface a ribbon stream of a second coating composition side-by-side to and in edge contact with said ribbon stream of said first coating composition.

9. Apparatus comprising an extrusion die adapted to applying at least one ribbon stream of a first coating composition to a surface of a support member, said extrusion die comprising an upper body, a lower body, and an extrusion slot between said upper body and said lower body, said upper body supporting a slide die comprising an upper lip forming an outlet slot in cooperation with said upper body and an inclined slide ramp recessed in said upper body, said slide ramp extending from said outlet slot to said extrusion slot, said slide die adapted to apply to said surface a ribbon stream of a second coating composition side-by-side to and in edge contact with said ribbon stream of said first coating composition.

10. Apparatus comprising an extrusion die adapted to applying at least one ribbon stream of a first coating composition to a surface of a support member, said extrusion die comprising an upper body, a lower body, and an extrusion slot between said upper body and said lower body, said upper body supporting a slide die comprising an upper lip forming an outlet slot in cooperation with said upper body and an inclined slide ramp recessed in said upper body, said slide ramp extending from said outlet slot to said extrusion slot, and at least one ground strip extrusion die mounted on one end of said extrusion die, said ground strip extrusion die being adapted to apply to said surface a ribbon stream of a second coating composition side-by-side to and in edge contact with with said ribbon stream of said first coating composition.

11. Apparatus comprising an extrusion die adapted to applying at least one ribbon stream of a first coating composition to a surface of a support member, said extrusion die comprising an upper body, a lower body, and an extrusion slot between said upper body and said lower body, said upper body supporting a slide die midway between opposite ends of said extrusion die, said slide die comprising an upper lip forming an outlet slot in cooperation with said upper body and an inclined slide ramp recessed in said upper body, said slide ramp extending from said outlet slot to said extrusion slot, and a ground strip extrusion die mounted at each of said ends of said extrusion die, each of said ground strip extrusion dies being adapted to apply to said surface a ribbon stream of a second coating composition side-by-side to and in edge contact with said ribbon stream of said first coating composition.

* * * * *